US007000955B2

(12) United States Patent
Heyder

(10) Patent No.: US 7,000,955 B2
(45) Date of Patent: Feb. 21, 2006

(54) PORTABLE CASEMENT WINDOW SECURING DEVICE

(76) Inventor: Roger Heyder, 650 Milverton Rd., Los Altos, CA (US) 94022

( * ) Notice: Subject to any disclaimer, the term of this patent is extended or adjusted under 35 U.S.C. 154(b) by 0 days.

(21) Appl. No.: 10/744,464

(22) Filed: Dec. 22, 2003

(65) Prior Publication Data

US 2004/0207215 A1 Oct. 21, 2004

Related U.S. Application Data

(60) Provisional application No. 60/464,149, filed on Apr. 21, 2003.

(51) Int. Cl.
*E05C 1/06* (2006.01)

(52) U.S. Cl. ..... 292/159; 292/288; 292/295; 292/DIG. 20; 292/DIG. 65; 70/32; 70/34; 70/38 R; 70/89; 70/90; 70/212

(58) Field of Classification Search ..... 292/159, 292/104, 137, 288, 289, 292, 295, DIG. 20, 292/DIG. 65, DIG. 2, 336.3; 70/89, 90, 70/211, 212, 202, 203, 208, 210, 20, 38 R, 70/32, 33, 34, 42, 201, 209
See application file for complete search history.

(56) References Cited

U.S. PATENT DOCUMENTS 165,741 A * 7/1875 Lockwood ..... 70/32
218,026 A * 7/1879 Hofmann ..... 70/32
221,405 A * 11/1879 Frederick et al. ..... 70/32
229,332 A * 6/1880 Pease ..... 70/40
640,775 A * 1/1900 Kerekes ..... 70/6
648,226 A * 4/1900 Atkinson ..... 70/32
765,172 A * 7/1904 Essig ..... 292/202
860,412 A * 7/1907 Robinson ..... 292/137
1,066,347 A * 7/1913 Voggenreiter ..... 292/251
1,280,993 A * 10/1918 Hammer ..... 292/159
1,300,125 A * 4/1919 Comerford ..... 70/212
1,439,552 A * 12/1922 Johnson ..... 70/428
1,681,416 A * 8/1928 Richard ..... 70/33
1,956,731 A * 5/1934 Reinhart ..... 70/90
2,107,056 A * 2/1938 Kistner ..... 70/89
2,214,884 A * 9/1940 Kistner ..... 70/89
2,443,850 A * 6/1948 Clapp ..... 70/89
2,463,195 A * 3/1949 Mungan ..... 70/416
2,482,340 A * 9/1949 Holmsten ..... 292/346
2,504,367 A * 4/1950 Arthur ..... 292/278
2,537,380 A * 1/1951 Travis ..... 292/288
2,613,523 A * 10/1952 Holmsten ..... 70/89
2,613,524 A * 10/1952 Holmsten ..... 70/89
2,613,525 A * 10/1952 Holmsten ..... 70/89
2,613,526 A * 10/1952 Holmsten ..... 70/90
2,963,895 A * 12/1960 Thomas ..... 70/14
3,094,861 A * 6/1963 Sayles ..... 70/95
3,167,945 A * 2/1965 Goodman ..... 70/428
3,270,536 A * 9/1966 Abraham ..... 70/89
3,416,827 A * 12/1968 Cole ..... 292/288
3,458,228 A * 7/1969 White ..... 292/359
3,468,142 A * 9/1969 Sprung ..... 70/89
3,591,219 A * 7/1971 Graziosi ..... 292/207
3,593,547 A * 7/1971 Taylor ..... 70/89
3,934,908 A * 1/1976 Rifkin ..... 292/150

(Continued)

*Primary Examiner*—Brian E. Glessner
*Assistant Examiner*—Carlos Lugo

(57) ABSTRACT

A compact, portable device for effectively locking a crank window in a user selected position. The body of the device can be selectively secured to or released from a window crank. When secured to the window crank, the device limits rotation of the crank by mechanical interference.

1 Claim, 4 Drawing Sheets

U.S. PATENT DOCUMENTS 4,003,227 A * 1/1977 Casey ..... 70/14
4,045,982 A * 9/1977 Gorton et al. ..... 70/90
4,478,442 A * 10/1984 Martin ..... 292/248
4,570,470 A * 2/1986 Gray, Sr. ..... 70/428
4,629,229 A * 12/1986 Correnti et al. ..... 292/246
4,932,708 A * 6/1990 Taub ..... 292/347
4,943,096 A * 7/1990 Looper ..... 292/213
5,141,119 A * 8/1992 Milazzo ..... 91/291
5,261,258 A * 11/1993 Bunger ..... 70/56
5,345,794 A * 9/1994 Jenks ..... 70/14
5,355,700 A * 10/1994 Suzuki ..... 70/89
5,946,952 A * 9/1999 Mintchenko ..... 70/2
6,018,968 A * 2/2000 Sides ..... 70/14
6,301,941 B1 * 10/2001 Nicholsfigueiredo ..... 70/211
6,367,292 B1 * 4/2002 Bunger ..... 70/56
6,416,089 B1 * 7/2002 Williams, Jr. ..... 292/288
6,604,764 B1 * 8/2003 Zemzik ..... 292/293
6,609,739 B1 * 8/2003 Avganim ..... 292/295
6,749,235 B1 * 6/2004 Crisp ..... 292/317
6,929,292 B1 * 8/2005 Galindo et al. ..... 292/288

* cited by examiner

PORTABLE CASEMENT WINDOW SECURING DEVICE

CROSS-REFERENCE TO RELATED APPLICATIONS

This application claims the benefit of PPA Ser. No. 60/464,149 filed Apr. 21/2003 by the present inventor.

FEDERALLY SPONSORED RESEARCH

Not Applicable

SEQUENCE LISTING OR PROGRAM

Not Applicable

BACKGROUND OF THE INVENTION

1. Field of Invention

This invention relates to securing crank windows, specifically to locking a crank window in a user selected position by allowing only partial rotation of the window crank while the securing device is in place.

2. Background of the Invention

The design of crank windows, frequently called casement windows, allows free rotation of the window crank unless the crank window is in the fully closed position with the securing latch engaged. When a crank window is partially open, anyone on the inside or outside can easily open the crank window further, posing a substantial security risk. A large deficiency in crank window design is that a crank window cannot be secured in a partially open position to allow ventilation.

A number of inventions have been developed for sliding windows to address the need to secure a sliding window while providing ventilation, but there is no such security device for crank windows. Existing crank window security devices focus on securing the window in a closed position via the latch. Currently available solutions for securely leaving a crank window partially open are grilles or an electronic screen linked to a burglar alarm system. Grilles require permanent, unsightly installation and prevent exit in case of emergency. Temporary grilles, such as child barriers, are bulky to install and remove, require adjustment of the grille to fit a specific window frame, and have the potential of being pulled out by a child. Electronic screens are expensive and require integration into a burglar alarm system, which many residences do not have.

BACKGROUND OF THE INVENTION—OBJECTS AND ADVANTAGES

Accordingly, several objects and advantages of my invention are:

1) a crank window can be secured at a user selected open position or when closed;

2) the securing device is compact and portable;

3) the securing device can be quickly secured, and released, by an entitled person;

4) no mechanical modification of the window, window frame, or sash are required;

5) a non-entitled person, such as a person outside or young children inside, cannot substantially open or close the window from its secured position People that wish to leave their crank window slightly open, while remaining secure, would want to employ this device. The device allows a crank window to be slightly open during the night to allow ventilation, while substantially reducing the possibility of a silent, rapid break-in through the window. Small children could play in a room with a window partially open without the risk of them further opening the window, and getting out or falling from the window. The device would also provide a reasonable impediment to reduce the risk of an easy break-in, and would be sought by those with missing or faulty crank window latches, or if someone wished to leave their window slightly open while they temporarily left their residence.

Further objects and advantages of my invention will become apparent from a consideration of the drawings and ensuing description.

SUMMARY

Accordance with the present invention a compact, portable device which releasably secures to the crank of a crank window and allows only limited rotation of the crank, effectively locking the crank window in a user selected position.

DRAWINGS—FIGURES

DRAWINGS—REFERENCE NUMERALS

| | |
|---|---|
| 10 | lower body member |
| 12a | body through-hole |
| 12b | body through-hole |
| 14 | lock mounting hole |
| 16a | lower slider recess |
| 16b | upper slider recess |
| 18 | lock |
| 20 | lock securing nut |
| 22 | slider |
| 24 | actuation slot |
| 26 | cam lever |
| 28 | lock cam |
| 30 | cam securing screw |
| 32 | upper body member |
| 36 | cam securing screw recess |
| 38 | single member body |
| 40 | crank handle slot |
| 42 | standard lock cam |
| 44 | left body member |
| 46 | edge connection hinge |
| 48 | right body member |
| 50a | crank handle recess |
| 50b | crank handle recess |
| 52a | securing through-hole |
| 52b | securing through-hole |
| 54a | securing hole access slot |
| 54b | securing hole access slot |

DETAILED DESCRIPTION—PREFERRED EMBODIMENT—FIGS. 1–3

Figure 1:
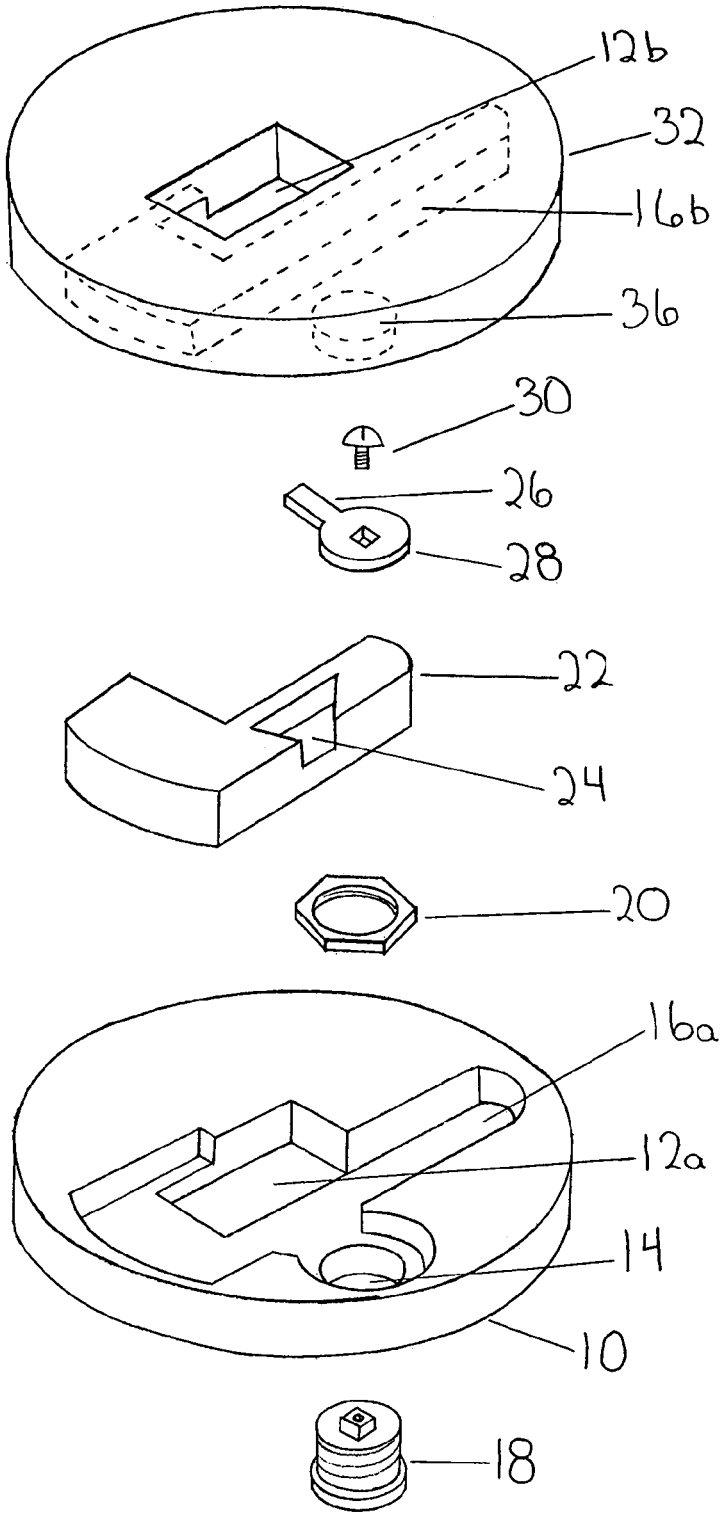
FIG. 1 is a perspective view of my invention

FIG. 1 shows a perspective view of my portable crank window securing device. Lower body member 10 includes body through-hole 12*a*, lock mounting hole 14, and lower slider recess 16*a*. Body through-hole 12*a* is sized to allow a crank window handle to pass through lower body member 10. Lock mounting hole 14 allows lock 18 to be secured to lower body member 10 with lock securing nut 20. Lower slider recess 16*a* accommodates slider 22. Slider 22 has actuation slot 24, which accommodates cam lever 26 of lock cam 28. Slider 22 fits into lower slider recess 16*a*, cam lever 26 fits into actuation slot 24, and cam securing screw 30 secures lock cam 28 to lock 18. When a correct key is inserted into lock 18 and turned, lock cam 28 rotates accordingly. Upper body member 32 includes body through-hole 12*b*, upper slider recess 16*b*, and cam securing screw recess 36. Body through-hole 12*b* in upper body member 32 corresponds to body through-hole 12*a* in lower body member 10. Upper slider recess 16*b* accommodates slider 22. Cam securing screw recess 36 allows space for cam securing screw 30 to fit into upper body member 32 when lower body member 10 is attached to upper body member 32. Lower body member 10 is attached to upper body member 32, using glue or other attachment means.

OPERATION OF INVENTION—PREFERRED EMBODIMENT

Figure 2:
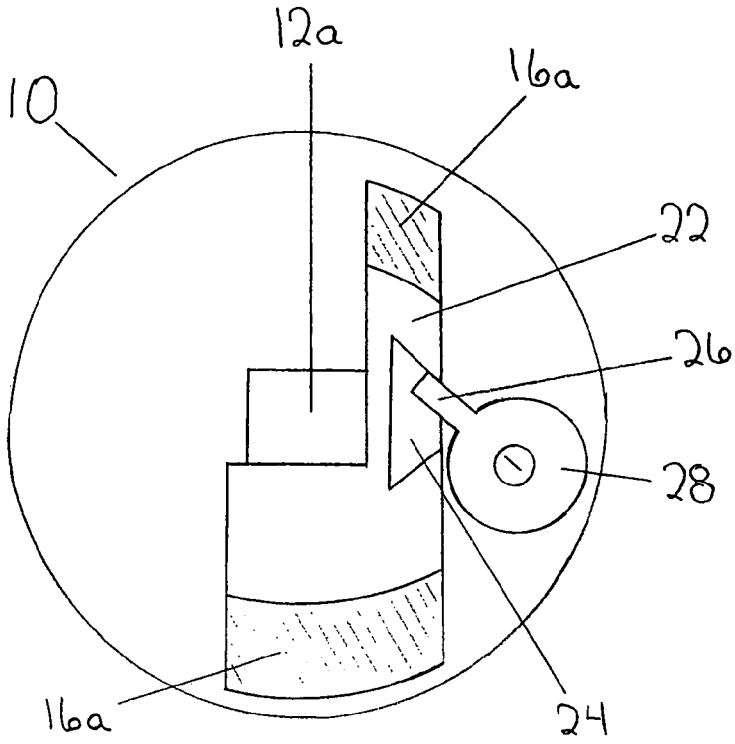
FIG. 2 is a plan view of slider in the secure position

FIG. 2 shows slider 22 in securing position. Cam lever 26 of lock cam 28 presses against the upper edge of actuation slot 24, holding slider 22 in securing position. With slider 22 in securing position, body through-hole 12*a* in lower body member 10 is reduced in size in the vertical dimension such that a crank window handle can no longer fit through. To move slider 22 to release position, lock cam 28 is rotated counterclockwise using a correct lock key. Cam lever 26 of lock cam 28 presses against the lower portion of actuation slot 24, moving slider 22 downwards along lower slider recess 16*a*. When slider 22 has traveled through its full motion along lower slider recess 16*a*, body through-hole 12*a* is fully open and a crank window handle can fit through.

Figure 3:
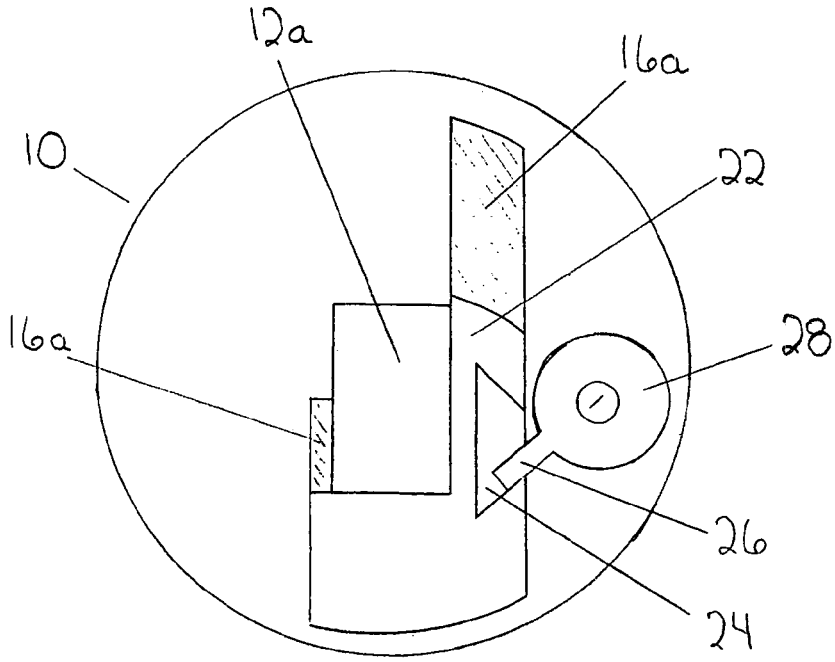
FIG. 3 is a plan view of slider in the release position

FIG. 3 shows slider 22 in release position. Cam lever 26 of lock cam 28 presses against the lower edge of actuation slot 24, holding slider 22 in release position. Slider 22 is moved from the release position to the securing position by rotating lock cam 28 clockwise using a correct lock key. Cam lever 26 of lock cam 28 presses against the upper portion of actuation slot 24, moving slider 22 upwards along lower slider recess 16*a* of lower body member 10. When slider 22 has traveled through its full motion along lower slider recess 16*a*, body through-hole 12*a* is reduced in size such that a crank window handle can no longer fit through.

The through-hole in the body is sized to allow the device to be slid over a crank window handle onto the crank window arm. When in securing position, slider 22 reduces the size of through-hole 12*a* and 12*b* such that the body can no longer be removed from the window crank. As the window crank is rotated, the body of the device will mechanically interfere with the window sill, crank handle base, or other window or window crank component to limit window crank rotation.

DESCRIPTION AND OPERATION OF ALTERNATIVE EMBODIMENTS

Figure 4:
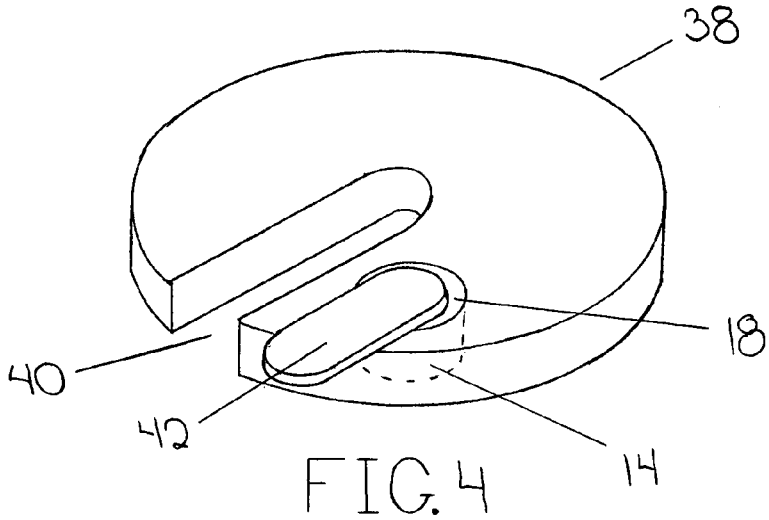
FIG. 4 is a bottom perspective view of a single member body device

Detailed Description—Single Member Body Device—FIG. 4

FIG. 4 shows a bottom perspective view of a single member body version of my portable crank window securing device. Single member body 38 includes crank handle slot 40 and lock mounting hole 14. Crank handle slot 40 is sized to allow a crank window handle to slide into single member body 38. Lock mounting hole 14 allows lock 18 to be secured to single member body 38 with adhesive or other fastening means. Standard lock cam 42 is installed on lock 18 with a snap connection or other fastening means. When a correct key is inserted into lock 18 and turned, standard lock cam 42 rotates accordingly.

Operation—Single Member Body Device

Single member body 38 is slid onto a crank window handle using crank handle slot 40. Single member body 38 is secured to the crank window handle when standard lock cam 42 is rotated clockwise with a correct lock key, effectively closing crank handle slot 40. As the crank window handle is rotated, the body of the device will mechanically interfere with the window sill, crank handle base, or other window or window crank component to limit crank window handle rotation. Single member body 38 is released from the crank window handle when standard lock cam 42 is rotated counter-clockwise with a correct lock key, effectively opening crank handle slot 40. Single member body 38 is then slid off the crank window handle along crank handle slot 40.

Figure 5:
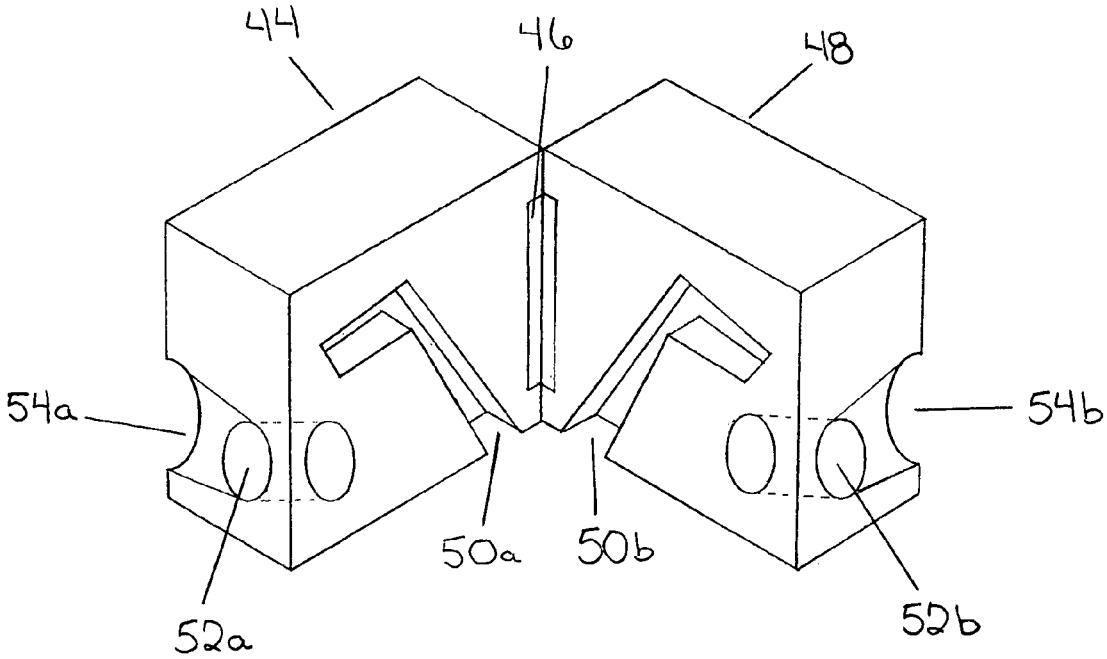
FIG. 5 is a perspective view of a clam-shell device

Detailed Description—Clam-shell Device—FIG. 5

FIG. 5 shows a perspective view of a clam-shell version of my portable crank window securing device. Left body member 44 includes crank handle recess 50*a*, securing through-hole 52*a*, securing hole access slot 54*a*, and a recess for edge connectoin hinge 46. Right body member 48 includes crank handle recess 50*b*, securing through-hole 52*b*, securing hole access slot 54*b*, and a recess for edge connection hinge 46. Left body member 44 and right body member 48 are connected along one edge by edge connection hinge 46, which allows left body member 44 to close against right body member 48. Crank handle recess 50*a* and crank handle recess 50*b* are sized to accommodate a crank window handle. Securing through-hole 52*a* and securing through-hole 52*b* are sized to accommodate a lock shackle. Securing hole access slot 54*a* and securing hole access slot 54*b* provide improved accessibility to securing through-hole 52*a* and securing through-hole 52*b* respectively.

Operation—Clam-shell Device

Left body member 44 and right body member 48 are positioned behind a crank window handle. Left body member 44 is closed against right body member 48, enclosing the crank window handle in crank handle recess 50*a* and crank handle recess 50*b*. A shackle of a lock is slid through securing through-hole 52*a* and securing through-hole 52*b*. The lock can then be locked and the device is secured to the crank window handle. As the crank window handle is rotated, the body of the device will mechanically interfere with the window sill, crank handle base, or other window or window crank component to limit crank window handle rotation. The device is released by unlocking the lock and sliding the lock shackle out of securing through-hole 52*b* and securing through-hole 52*a*. Left body member 44 can then be rotated away from right body member 48 around edge connection hinge 46, releasing the crank window handle from crank handle recess 50*a* and crank handle recess 50*b*. Left body member 44 and right body member 48 can be lifted away from the crank window handle.

CONCLUSION, RAMIFICATIONS, AND SCOPE OF INVENTION

Figure 6:
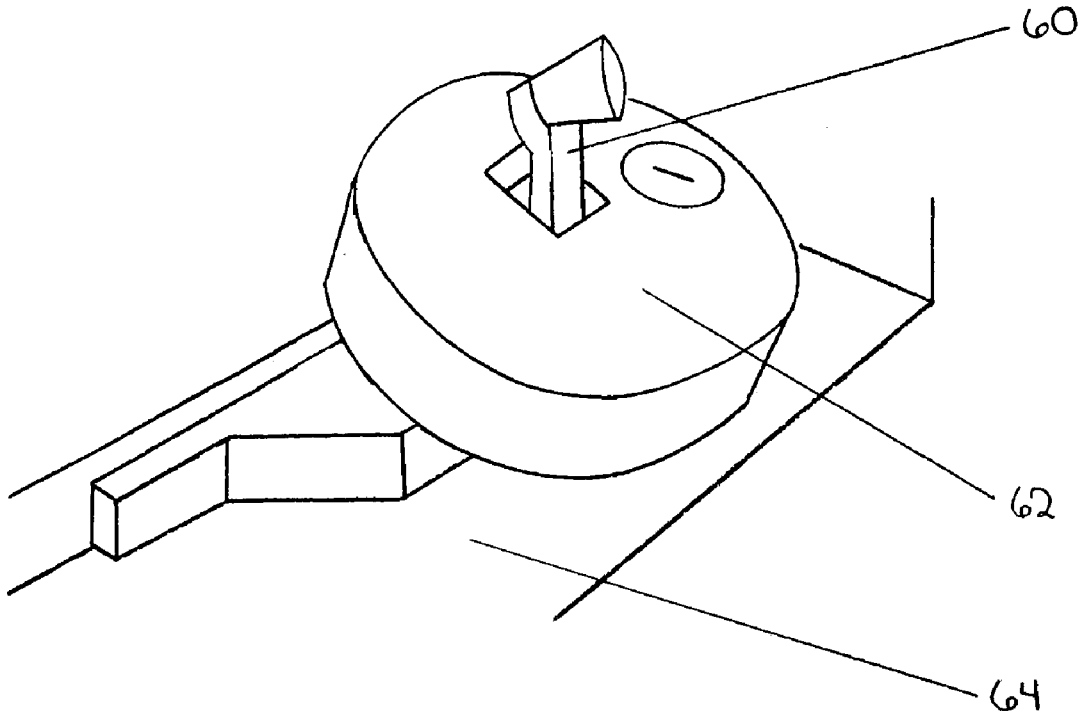
FIG. 6 is a perspective view of Applicant's securing device attached to a casement window crank.

Detailed Description—Securing Device Attached to Window Crank-FIG. 6

FIG. 6 shows my portable casement window securing device attached to the crank of a casement window.

The reader will see that the securing device of the invention provides a portable, easy to use device for providing crank window security. While the above description contains some specificities, these should not be construed as limitations on the scope of the invention, but rather as an exemplification of one preferred embodiment thereof. Many other variations are possible, which are primarily related to, but not limited to, the shape and size of the body, various members comprising the body and how they fit and connect together, how the body is secured to the crank window handle, and materials that the device can be made of.

The device could take any number of shapes or forms and still function in the desired manner. The body, or the body plus the means of releasably securing the body, needs to be large enough to cause mechanical interference with the window sill, crank handle base, or other window or window crank member to limit crank rotation. The body could be composed of one or several members, and these members could be connected to one another by a variety of means. The means of releasably securing the body to the crank handle could contribute required dimension to the body to meet the mechanical interference size requirement. The body could be quite large and potentially fit over the entire window crank element. The device could be shaped internally to conform to or accommodate the crank handle base or crank handle itself. Minimizing window sill damage associated with crank rotation with the device in place is a consideration, but not a limitation.

The body could be releasably secured to the crank handle by many means, including but not limited to a hinge, pivot pin, two clamping points each with a securing mechanism, locks, or a U clamp. There are numerous ways to accomplish secure closure, including different types and applications of locks as well as other types of mechanical keys and fasteners. These mechanical lock alternatives could include devices such as a gear with a spring-loaded rotation inhibitor, which may be applicable for child security applications of the device. The device could slide over the top of the crank handle and secure to the crank arm or crank handle by a slider or other means of constricting the through-hole size. The through-hole could take any number of shapes and still function in the desired manner. The device could also use bands, or other types of fasteners, to attach a rotation limiting body to the crank window handle.

The device could be fabricated out of any number of materials, which could include but would not be limited to plastic, metal, hard rubber, wood, other synthetic material, or any combination of these materials. The device could be fabricated from material of any color, or combination of colors.

The device could be attached to a tether to keep it convenient to a selected window, reducing portability but retaining the function and utility of the device.

The device could incorporate sensors and/or other electrical and mechanical components that would allow the device to function as a stand alone alarm or be integrated into an existing alarm system.

Accordingly, the scope of the invention should be determined not by the embodiments illustrated, but by the appended claims and their legal equivalent.

What is claimed is:

1. A portable casement window securing device comprising:

a) a disk shaped body of predetermined size;

b) a hole in said disk shaped body that allows said disk shaped body to be fitted onto a casement window crank handle;

c) a lock-actuated sliding bar internal to said disk shaped body which when extended reduces the size of said hole, such that when said hole size is reduced said disk shaped body can no longer be removed from said casement window crank handle;

whereby when the device is secured to said crank handle of said casement window, rotation of said crank handle is limited and said casement window is effectively locked in position.

* * * * *